US006161522A

United States Patent [19]

Fuchita et al.

[11] Patent Number: 6,161,522

[45] Date of Patent: Dec. 19, 2000

[54] CONTROLLER OF ENGINE AND VARIABLE CAPACITY PUMP

[75] Inventors: Seiichi Fuchita, Katano; Fujitoshi Takamura; Junichi Tanaka, both of Hirakata, all of Japan

[73] Assignee: Komatsu, Ltd., Tokyo, Japan

[21] Appl. No.: 09/341,898

[22] PCT Filed: Jan. 20, 1998

[86] PCT No.: PCT/JP98/00186

§ 371 Date: Jul. 20, 1999

§ 102(e) Date: Nov. 20, 1999

[87] PCT Pub. No.: WO98/31926

PCT Pub. Date: Jul. 23, 1998

[30] Foreign Application Priority Data

Jan. 20, 1997 [JP] Japan ..... 9-19623

[51] Int. Cl.[7] ..... F02B 23/00

[52] U.S. Cl. ..... 123/385; 123/357

[58] Field of Search ..... 123/385, 386, 123/387, 357, 358, 259

[56] References Cited

U.S. PATENT DOCUMENTS

| | | | |
|---|---|---|---|
| 4,773,369 | 9/1988 | Kobayashi | 123/385 |
| 4,774,921 | 10/1988 | Sakaguchi | 123/385 |
| 5,468,126 | 11/1995 | Lukich | 123/385 |
| 5,878,721 | 3/1999 | Nakamura | 123/385 |

FOREIGN PATENT DOCUMENTS

| | | |
|---|---|---|
| 61-190488 | 11/1986 | Japan . |
| 3-225052 | 10/1991 | Japan . |
| 7-189764 | 7/1995 | Japan . |
| 8-218442 | 8/1996 | Japan . |
| 2566750 | 10/1996 | Japan . |
| 10-042587 | 2/1998 | Japan . |

*Primary Examiner*—Carl S. Miller
*Attorney, Agent, or Firm*—Sidley & Austin

[57] ABSTRACT

The invention provides a controller of an engine and a variable capacity pump which can perform a speedy work even under a heavy load and a strong work at the critical moment. Accordingly, there is provided control means (30) which outputs commands to a fuel injection pump (2), relief control means (19, 21) and variable capacity pump output control means (27, 29) so that when a signal for an on operation of an active mode switch (7) is inputted, the product of a pump discharge pressure P by a pump discharge amount Q is expressed by a P-Q constant horsepower curve Ha in an active mode in which the product of P and Q is higher than a predetermined value in the normal operation, and when a signal for an on operation of a power mode switch (9) is inputted, the product of the pump discharge pressure P by the pump discharge amount Q is expressed by a P-Q constant horsepower curve Hap in a power active mode in which the product of P and Q is higher than that in the active mode by one stage.

13 Claims, 5 Drawing Sheets

CONTROLLER OF ENGINE AND VARIABLE CAPACITY PUMP

FIELD OF THE INVENTION

The present invention relates to a controller of an engine and a variable capacity pump which performs a pressure increase control for a hydraulic circuit, a control for increasing an engine rotational speed and a control for a pump absorption torque so as to coincide with an engine output torque when selecting a power active mode, in order to facilitate a heavy excavation at a time of operating a construction machine such as a hydraulic excavator and the like.

BACKGROUND OF THE INVENTION

A hydraulic circuit shown in FIG. 6 is employed in a conventional construction machine such as a hydraulic excavator and the like. The hydraulic circuit is provided with a variable capacity pump 11 (hereinafter, referred to as a pump 11) driven by an engine 1 and a pilot pump 81. An angle of a swash plate in the pump 11 is controlled by a servo piston 12, and an operation pressure of the servo piston 12 is controlled by a servo control valve 200. An operation portion 200*a* of the servo control valve 200 is connected to a neutral control valve 210 (hereinafter, refer to as an NC valve 210), a cut-off valve 220 (hereinafter, refer to as a CO valve 220) and a torque variable control valve 230 (hereinafter, refer to as a TVC valve 230) in series. A pipe passage 202 branched from a discharge pipe passage 201 of the pump 11 is connected to each of the operation portions in the CO valve 220 and the TVC valve 230. A pipe passage 222 branched from a discharge pipe passage 221 of the pilot pump 81 is connected to the operation portion 200a in the servo valve 200 via the TVC valve 230, the CO valve 220 and the NC valve 210. An engine rotation sensor 5 for detecting a rotational speed of the engine 1 is connected to a controller 240. The controller 240 is connected to the TVC valve 230.

Further, the discharge pipe passage 200 of the pump 11 is connected to a direction switch valve 250. The direction switch valve 250 is connected to a hydraulic cylinder 260 via pipe passages 251*a* and 251*b* and also connected to a jet sensor (a pressure detecting portion) 253 via a pipe passage 252. The jet sensor 253 is connected to a drain passage 254.

Still further, a discharge pipe passage 223 branched from the discharge pipe passage 221 in the pilot pump 81 is connected to a pressure proportional control valve 270 and an operation lever 271 is connected to the pressure proportional control valve 270. The pressure proportional control valve 270 is connected to an operation portion of the direction switch valve 250 via pipe passages 272*a* and 272*b*.

An operation of the controller mentioned above will be described below. The NC valve 210 receives a pressure detected by the jet sensor 253 at an operation portion in one side from a pipe passage 256 and receives a pressure detected by the drain pipe passage 254 disposed downstream the jet sensor 253 at an operation portion in the other side from a pipe passage 257, thereby being switched in accordance with a differential pressure between a front and a back of the jet sensor 253. Since all the discharge flow amount of the pump 11 is drained from the drain passage 254 to a tank 258 via the jet sensor 253 when the direction switch valve 250 becomes a neutral position shown in the drawing, a pressure downstream of the jet sensor 253 becomes high and the NC valve 210 is switched to a port position 210*b*. Accordingly, the servo valve 200 becomes at a port position 200*c* so as to move the servo piston 12 to a left side in the drawing and reduce a flow amount of the pump 11. Therefore, an energy loss at a neutral position of the direction switch valve 250 is reduced.

Next, since no oil flows in the jet sensor 253 when an operator switches the direction switch valve 250, the NC valve is switched to the port position 210*a*. Further, a rotational speed signal from the engine rotation sensor 5 in the engine 1 is always input to the controller 240, and a command signal is input to the operation portion 230*a* of the TVC valve 230 from the controller 240 in correspondence to the rotational speed signal. In this case, a discharge pressure of the pump 11 is input to the operation portion 230*b* of the TVC valve 230.

In this case, when the discharge pressure of the pump 11 is lower with respect to the command signal of the engine rotational speed signal, the port position of the TVC valve 230 is switched to a position indicated by 230*c* and the CO valve 220 is switched to a position indicated by 220*a*. Since the NC valve 210 is at the port position 210*a* as mentioned above and the pilot pressure from the pipe passage 222 is accordingly input to the operation portion 200*a* of the servo valve 200, the servo valve 200 is switched to a position indicated by 200*b*. Therefore, oil in the side of a head of the servo piston 12 is drained, pressurized oil from the pipe passage 222 is flowed into a bottom side, and the servo piston 12 moves rightward so as to increase the pump discharge amount.

On the contrary, when the discharge pressure of the pump 11 is higher with respect to the command signal of the engine rotational speed, the TVC valve 230 is switched to a position indicated by 230*d* and the pilot pressure from the pipe passage 222 is not input to the operation portion 200*a* of the servo valve 200, so that the servo valve 200 is switched to the position indicated by 200*c*. Therefore, the pressurized oil from the pipe passage 221 is flowed into the head side of the servo piston 12, oil in the bottom side is drained, and the servo piston 12 moves leftward so as to reduce the pump discharge amount.

Since the CO valve 220 is structured such that a force of a spring 220*b* is set to be larger in comparison with the discharge pressure of the pump 11, it is normally at the position indicated by 220*a*. Further, the CO valve 220 is structured such as to be switched to the position indicated by 220*c* when the pump 11 reaches a maximum pressure and is also structured such as to perform a cut off control for further reducing a flow amount under the maximum pressure.

The TVC valve 230 is structured such as to control so that a discharge flow amount Q [Q=q(cc,/rev)·N] of the pump 11 becomes constant in correspondence to an engine rotational speed N and a discharge pressure P of the pump 11, and an absorption horsepower of the pump 11 is controlled on a constant line having a substantially equivalent horsepower P·Q=Constant as shown by a dotted line Hs in a P-Q graph in FIG. 3.

Recently, in order to increase a work force and a work speed in correspondence to a load condition of a work, it is structured such as to change the P-Q graph in FIG. 3 and change a matching point (A1) between the engine output torque and the pump absorption torque as shown in FIG. 2.

For example, a controller which the applicant suggests in Japanese Patent Application No. 7-46508, comprises active mode selecting and canceling means having an engine, a variable capacity pump driven thereby, pump output control means for controlling so that the product of a load pressure acting on the pump by a discharge volume becomes substantially constant, a work apparatus receiving a pressurized oil from the pump and operated by an actuator and a switch selecting an engine output torque and a pump absorption torque in accordance with a work and performing a heavy excavation and the like, engine fuel injection position setting means for supplying a fuel by which the engine outputs a rated output torque in accordance with a selection of an active mode, active mode switching means for switching a set pressure of a relief valve for adjusting an oil pressure to the actuator in accordance with the selection of the active mode, a safety valve and the like, and control valve for outputting a command to the engine fuel injection position setting means and the active mode switching means by receiving a signal from the active mode selecting and canceling means.

However, in some condition of a work field or some work load condition, it is desired to increase up the work force and the work speed further in comparison with the active mode.

Accordingly, it is necessary to increase the engine output, the engine rotational speed, and the main relief set pressure of the hydraulic circuit in the working machine further in comparison with the active mode at a time of a heavy excavating operation. In accordance with this, the control of the matching point between the engine output torque and the pump absorption torque is changed, whereby the work force and the work speed is further increased, so that a controller in which a speedy work can be performed even under a heavy load and a strong work. at the critical moment can be performed is required.

SUMMARY OF THE INVENTION

The present invention is made by taking the conventional problems mentioned above into consideration, and an object of the present invention is to provide an engine and a variable capacity pump in which an engine output, an engine rotational speed and a set pressure of a hydraulic circuit in a working machine are increased by operating a switch for an active mode and a power mode, so that a speedy work can be performed even under a heavy load and a strong work at the critical moment can be performed, when it is desired to further increase a work force and a work speed in correspondence to a condition of a work field or a work load condition.

In accordance with a first aspect of the present invention, there is provided a controller of an engine and a variable capacity pump having an injection pump for adjusting an injection amount of an engine, a variable capacity pump driven by the engine and pump output control means for controlling so that the product of a load pressure acting on the variable capacity pump by a pump discharge amount substantially becomes a predetermined constant value at a time of a normal operation, wherein the controller comprises control means which outputs commands to a fuel injection pump for adjusting the injection amount of the engine, relief control means for variably changing a set pressure of a discharge pipe passage in the variable capacity pump and variable capacity pump output control means so that when a signal for an on operation of an active mode switch is inputted, the product of a pump discharge pressure P by a pump discharge amount Q is expressed by a P-Q constant horsepower curve Ha in an active mode in which the product of P and Q is higher than a predetermined value in the normal operation, and when a signal for an on operation of a power mode switch is inputted, the product of the pump discharge pressure P by the pump discharge amount Q is expressed by a P-Q constant horsepower curve Hap in a power active mode in which the product of P and Q is higher than that in the active mode by one stage.

In accordance with the structure mentioned above, in the case of selecting the power active mode, a control is performed so that the product of the pump discharge pressure P by the pump discharge amount Q is expressed by the P-Q constant horsepower curve Hap in the power active mode. Accordingly, since it is possible to further increase the work force and the work speed in comparison with the active mode, a speedy work can be performed even under a heavy load, so that a working performance is improved.

In accordance with a second aspect of the present invention, there is provided a controller of an engine and a variable capacity pump as cited in the structure of the first aspect, wherein the control means outputs commands to the fuel injection pump for adjusting the injection amount of the engine, the relief control means for variably changing a set pressure of a discharge pipe passage in the variable capacity pump and the variable capacity pump output control means so as to return the control to the P-Q constant horsepower curve Ha in the active mode after a predetermined time has passed from a time when controlling in accordance with the P-Q constant horsepower curve Hap in the power active mode.

In accordance with the structure mentioned above, the control is performed in accordance with the P-Q constant horsepower curve Hap in the power active mode and this is cancelled after the predetermined time has passed. As mentioned above, since an increase of the work force and the work speed at the critical moment is performed only for the predetermined time, it is possible to reduce a specific fuel consumption as well as improve an excavation performance.

DETAILED DESCRIPTION OF THE INVENTION

Hereinafter, a controller of an engine and a variable capacity pump in accordance with an embodiment of the present invention will be described below with reference to FIGS. 1 to 5.

Figure 1:
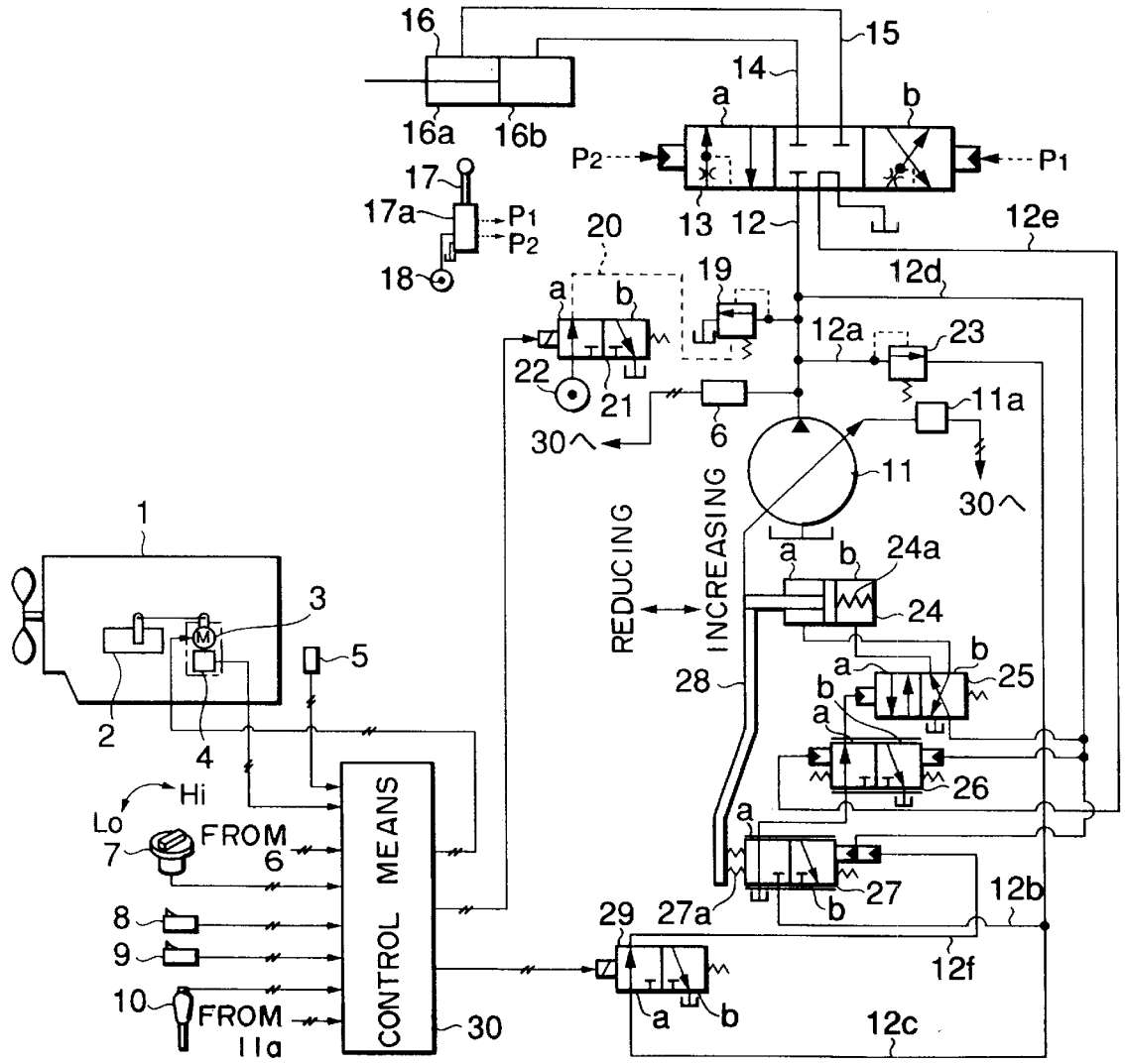
FIG. 1 is a schematic view of a controller of an engine and a variable capacity pump in accordance with an embodiment of the present invention.

A fuel injection pump 2 is mounted on an engine 1 as shown in FIG. 1. A governor (not shown) is installed in the fuel injection pump 2 and is driven by a governor motor 3. The governor motor 3 is connected to control means 30. Further, a position of the governor motor 3 is detected by a governor position sensor 4 and a detected signal is input to the control means 30. A rotational speed of an output shaft in the engine 1 is detected by an engine rotational speed sensor 5 and the detected signal is input to the control means 30.

A signal is input to the control means 30 from a fuel dial 7 for adjusting a throttle amount. A signal from an active mode switch 8 and a signal from a power mode switch 9 are also input to the control means 30. A signal from a switch 10 attached to a working machine lever 17 (hereinafter, referred to as a lever switch 10) is also input to the control means 30.

The engine 1 drives a variable capacity pump 11 (hereinafter, referred to as a pump 11). Pressurized oil discharged from the pump 11 is supplied to a hydraulic cylinder 16 via pipe passages 14 and 15 from a pipe passage 12 after passing through a direction switching valve 13. The hydraulic cylinder 16 is exemplified as a hydraulic cylinder for a boom, an arm, a bucket and the like constituting a working machine of a hydraulic excavator, and FIG. 1 shows only one oil hydraulic cylinder circuit.

Pilot pressure generating means 17*a* interlocking with the working machine lever 17 outputs pilot pressures P1 and P2 from a hydraulic source 18. These pilot pressures P1 and P2 are input to operation portions at both ends of the direction switching valve 13. For example, when outputting the pilot pressure P1 by an operation of the working machine lever 17, the direction switching valve 13 is switched to a b position, a pressurized oil discharged from the pump 11 flows into a head chamber 16*a* of the hydraulic cylinder 16 from the pipe passage 15 after passing through the direction switching valve 13 from the pipe passage 12, and the hydraulic cylinder 16 is shortened.

When outputting the pilot pressure P2 by an operation of the working machine lever 17, the direction switching valve 13 is switched to an a position, the pressurized oil discharged from the pump 11 flows into a bottom chamber 16*b* of the hydraulic cylinder 16 from the pipe passage 14 after passing through the valve 13 from the pipe passage 12, and the hydraulic cylinder 16 is extended.

A relief valve 19 is interposed in a pipe passage branched from the discharge pipe passage 12 of the pump 11. A pressure of the hydraulic cylinder 16 is adjusted by a set pressure of the relief valve 19. For example, in the case of an active mode mentioned below, the set pressure of the relief valve 19 is set to 325 kg/cm$^2$ and in the case of a power active mode, the set pressure of the relief valve 19 is set to 355 kg/cm$^2$. In this case, it is structured such that the pilot pressure from a hydraulic source 22 passes through a pilot pipe passage 20 via a switch valve 21 and acts on a spring side of the relief valve 19. The switch valve 21 is connected to the control means 30 and is switched on the basis of a command of the control means 30, however, is normally at the b position by being urged by a spring. In this case, the relief valve 19 and the switch valve 21 constitute relief control means.

A pressure sensor 6 for detecting the pump pressure is interposed in a pipe passage branched from the discharge pipe 12 of the pump 11. A signal from the pressure sensor 6 is input to the control means 30. A signal from a swash plate angle sensor 11*a* for detecting an angle of a swash plate of the pump 11 is also input to the control means 30.

The angle of the swash plate of the pump 11 is controlled by a servo piston 24 having a spring 24*a* installed. A servo valve 25 for supplying a control pressure to the servo piston 24 is connected to a conduit 12*d* branched from the discharge pipe passage 12 of the pump 11. An operation portion of the servo valve 25 is connected to a torque variable control valve 27 (hereinafter, referred to as a TVC valve 27) for controlling an output of the pump 11 in a substantially equal horsepower via a load sensing valve 26 (hereinafter, referred to as an LS valve 26). The TVC valve 27 is connected to a self-pressure control valve 23 interposed in a conduit 12*a* branched from the discharge pipe passage 12 of the pump 11 via a conduit 12*b*.

One end of the operation portion of the LS valve 26 is connected to the conduit 12*d* branched from the discharge pipe passage 12 of the pump 11, and the other end of the LS valve 26 is connected to a conduit 12*e* to which a load pressure of the hydraulic cylinder 16 is introduced via the direction switch valve 13. The LS valve 26 is controlled on the basis of a differential pressure between the pump pressure discharged from the pump 11 and a load pressure of the hydraulic cylinder 16.

Further, an operation portion of the TVC valve 27 is connected to a conduit 12*f* via the self-pressure control valve 23, the conduit 12*c* and an electromagnetic valve 29. Two springs 27*a* and 27*a* are arranged in the TVC valve 27, and the springs 27*a* and 27*a* are brought into contact with a pressing member 28 connected to the servo piston 24. The springs 27*a* and 27*a* pushes the pressing member 28 so as to operate the servo piston 24 as well as being pushed by a piston (not shown) of the TVC valve 27 so as to be bent, thereby controlling the angle of the swash plate of the pump 11. Accordingly, a discharge capacity of the pump 11 becomes variable, and a control is performed so as to become a substantially equal horsepower as mentioned above. In this case, the structure is made such that the electromagnetic valve 29 is connected to the control means 30 so as to be opened and closed in accordance with a command of the control means 30.

Figure 2:
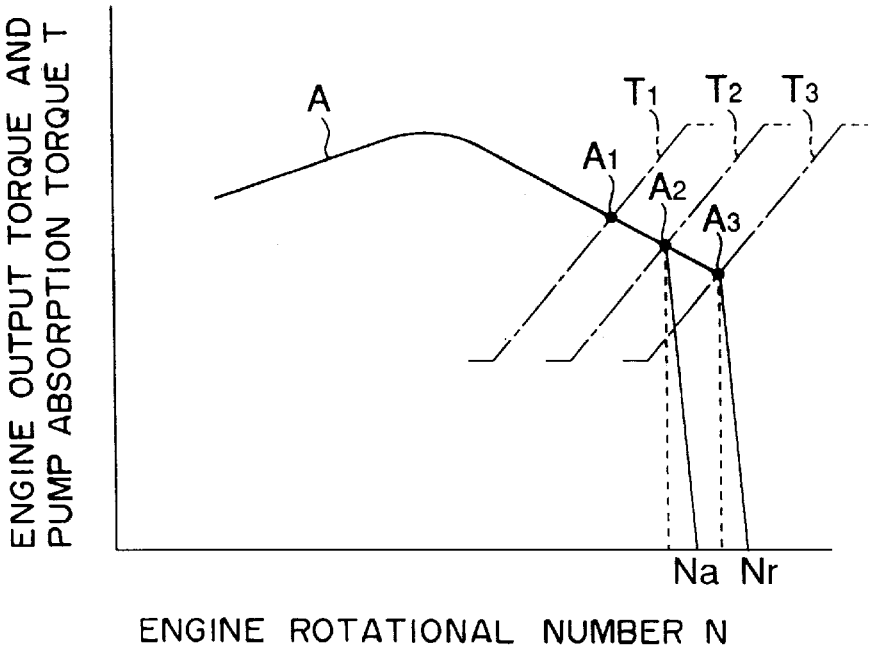
FIG. 2 is a graph which shows a matching point between an engine output torque curve and a pump absorption torque.

Next, a description will be given of a relation between a hydraulic pump absorption torque in correspondence to an engine output torque curve A and matching points A1, A2 and A3 with reference to FIG. 2.

In the case of a standard mode which has been conventionally employed, it is structured such that a hydraulic pump absorption torque T1 in correspondence to the engine output torque curve A is matched at the A1 point. In the case of the active mode, it is structured such that a hydraulic pump absorption torque T2 in correspondence to the engine output torque curve A is matched at the A2 point. When being controlled to the active mode, an engine rotational speed Na is set.

Then, in the case of the power active mode in accordance with the present invention, it is structured such that a hydraulic pump absorption torque T3 in correspondence to the engine output torque curve A is matched at the point A3. When being controlled to the power active mode, an engine rotational speed Nr is set.

Figure 3:
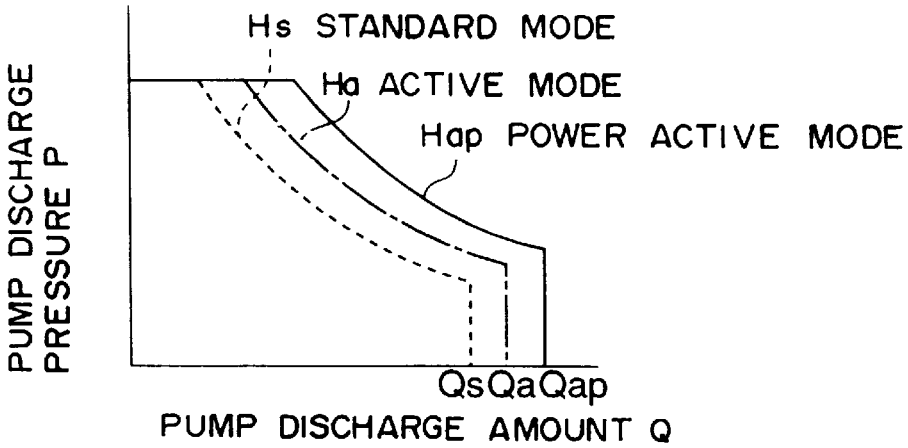
FIG. 3 is a P-Q graph of a pump discharge pressure and a pump discharge amount.

FIG. 3 shows P-Q curves in a standard mode, an active mode and a power active mode. In the case of the standard mode shown by a dot line Hs, a pump discharge amount Qs is set. In the case of the active mode shown by a single dot chain line Ha, a pump discharge amount Qa is set.

In the case of the power active mode shown by a solid line Hap in accordance with the present invention, a pump discharge amount Qap is set. As mentioned above, a control is performed so that the pump discharge amount is increased in the order of the standard mode, the active mode and the power active mode, and the control is performed on a constant line having a substantially equal horsepower (P·Q= Constant).

The work force and the work speed are increased in accordance with the power active mode, an excavation can be easily performed even under a heavy load, and further a speedy work can be performed.

Next, an operation of the present embodiment will be described below.

In the case of selecting the power active mode, the control means 30 outputs a command to the governor motor 3 of the fuel injection pump 2 so as to increase the engine rotational speed more than the engine rotational speed Na in the active mode. Accordingly, the engine rotational speed Nr in the power active mode is set. Further, the control means 30 outputs a command to the TVC valve 27 via the electromagnetic valve 29 so that the hydraulic pump absorption torque T3 corresponding to the engine output torque curve A is matched at the point A3. Accordingly, the engine target rotational speed Nr for further increasing the engine rotational speed is set, and the hydraulic pump absorption torque T3 which is set in accordance therewith is matched on the engine torque curve.

Further, in the case of selecting the power active mode, since a control is performed so that the product of the pump discharge pressure P by the pump discharge amount Q in a mode higher than the active mode by one stage can be expressed by the P-Q constant horsepower curve Hap in the power active mode, it is possible to increase the work force and the work speed. Accordingly, a speedy work can be performed even under a heavy load and a working performance can be improved.

Still further, it is structured such that a cancellation is performed after a predetermined time has passed from the time when being controlled to the P-Q constant horsepower curve Hap in the power active mode. Further, in the case of selecting the power active mode, since the structure is made such as to increase the set pressure of the relief valve 19, the working machine can stand against the heavy load (the working machine can stand firm without breaking down) when a force at the critical moment is necessary, so that the working machine can output a sufficient force even under a heavy load and a working performance can be improved.

Furthermore, in the case of selecting the power active mode, since it is set such that the control for increasing the engine target rotational number Nr and increasing the set pressure of the relief valve 19 is cancelled after a predetermined time has passed, an increase of the work force at the critical moment and the work speed is performed for a predetermined time, so that it is possible to reduce a specific fuel consumption as well as improve an excavating performance.

Next, a control of the controller of the engine and the variable capacity pump in accordance with the present embodiment will be described below with reference to flow charts shown in FIGS. 4 and 5.

Figure 4:
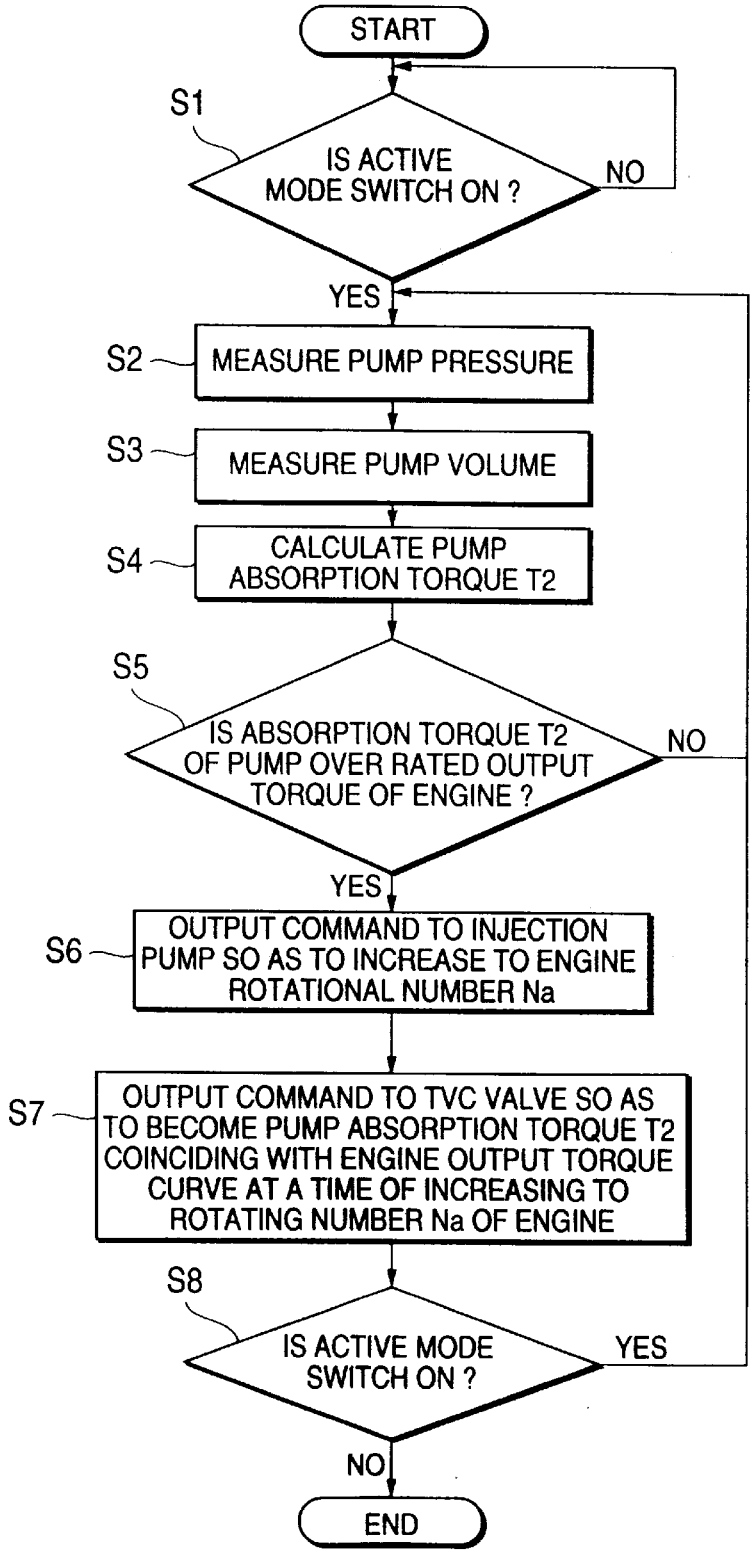
FIG. 4 is a flow chart of a control in an active mode.

In the control flow chart in the active mode shown in FIG. 4, in a step S1, it is judged whether or not the active mode switch 8 is in an on state. Here, when NO is established, the step returns to the step S1, and when YES is established, in a step S2, a pump pressure detected by the pressure sensor 6 is measured.

In a step S3, a pump volume is measured. A signal from the swash plate angle sensor 11*a* for detecting the angle of the swash plate in the pump 11 is input to the control means 30, and the pump volume can be calculated by the signal. Further, the structure may be made such that the pump volume is calculated in accordance with a previously stored function from the pump pressure.

In a step S4, the pump absorption torque T2 in the active mode is calculated. In a step S5, it is judged whether or not the pump absorption torque T2 becomes over the rated output torque of the engine, and when NO is established, the step returns to the step S2 and when YES is established, in a step S6, a command is output to the governor motor 3 of the fuel injection pump 2 so as to increase to the engine rotational number Na in the active mode.

In a step S7, a command is output to the TVC valve 27 via the electromagnetic valve 29 so as to become the pump absorption torque T2 coinciding with the engine output torque curve at a time of increasing to the engine rotational number Na in the active mode.

In a step S8, it is judged whether or not the active mode switch is in an on state, and when YES is established, the step 8 returns to the step S2 and when NO is established, the step 8 ends.

Figure 5:
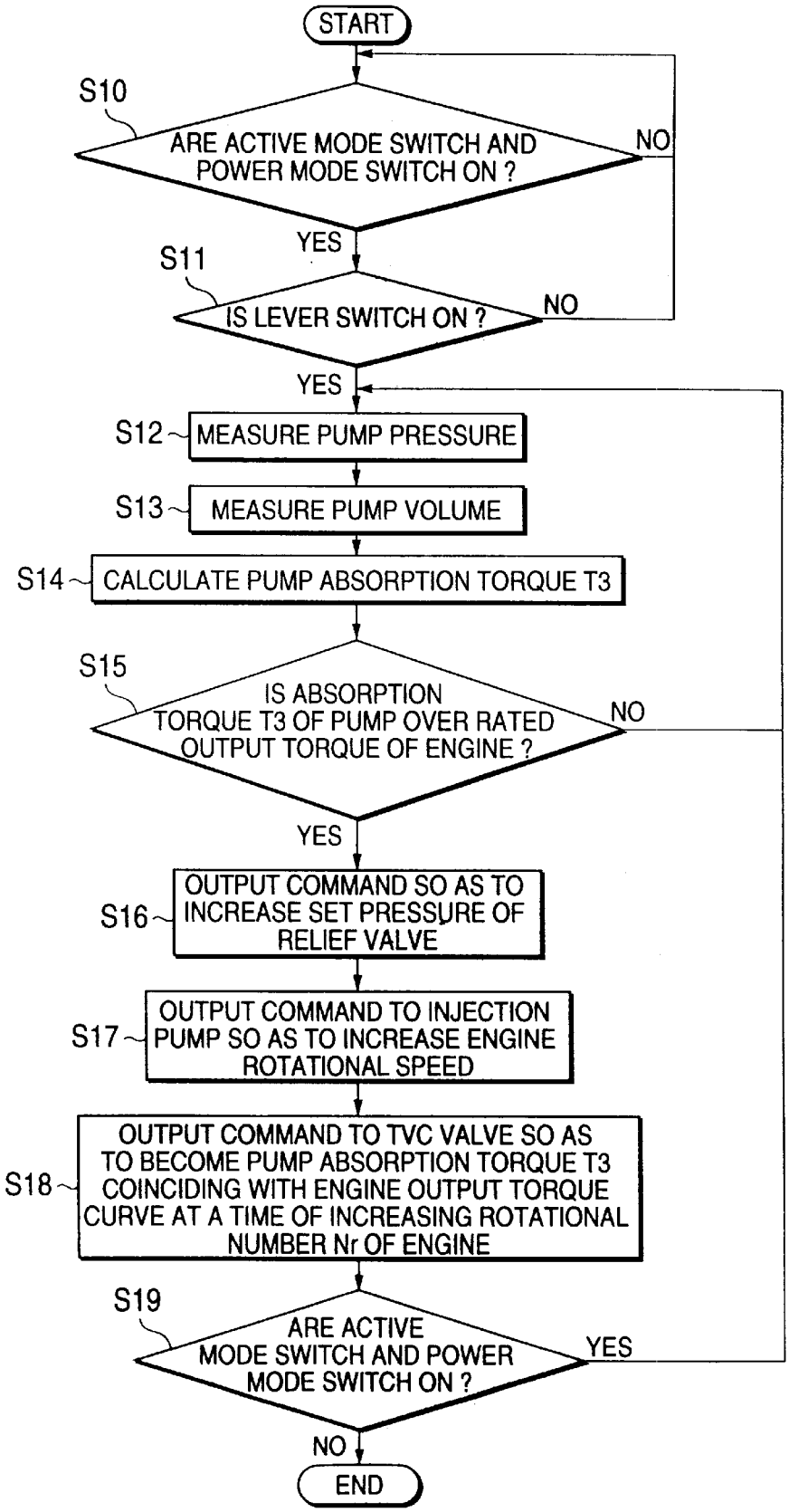
FIG. 5 is a flow chart of a control in a power active mode.
Figure 6:
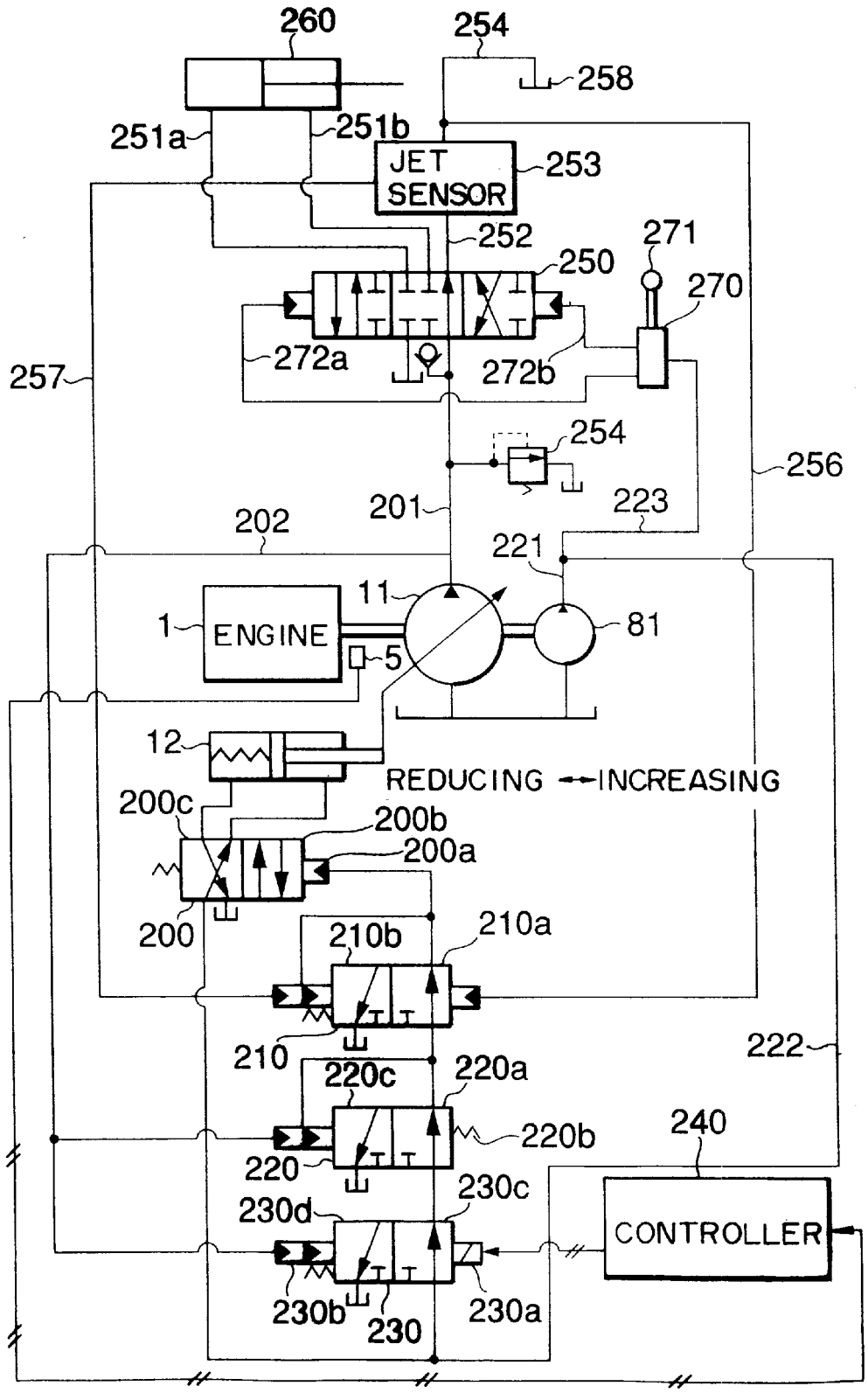
FIG.6 PRIOR ART
FIG. 6 is a schematic view of a conventional controller of a variable capacity pump.

In the control flow chart in the power active mode shown in FIG. 5, in a step S10, it is judged whether or not the active mode switch 8 and the power mode switch 9 are in an on state. In this case, when NO is established, the step returns to the step S10, and when YES is established, in a step S11, it is judged whether or not the working machine lever switch 10 is in an on state. In this case, when NO is established, the step returns to the step S10, and when YES is established, in a step S12, the pump pressure detected by the pressure sensor 6 is measured.

In a step S13, the pump volume is measured. A signal from the swash plate angle sensor 11*a* detecting the angle of the swash plate in the pump 11 is input to the control means 30 and the pump volume can be calculated by the signal. Further, the structure may be made such that the pump volume can be calculated in accordance with a previously stored function from the pump pressure.

In a step S14, the pump absorption torque T3 in the power active mode is calculated.

In a step S15, it is judged whether or not the pump absorption torque T3 becomes over the rated output torque of the engine. In this case, when NO is established, the step returns to the step S12, and when YES is established, in a step S16, a command is output to the switch valve 21 from the control means 30 so as to increase the set pressure of the relief valve 19.

In a step S17, a command is output to the governor motor 3 of the fuel injection pump 2 from the control means 30 so as to increase to the engine rotational number Nr in the power active mode.

In a step S18, a command is output to the TVC valve 27 via the electromagnetic valve 29 so as to become the pump absorption torque T3 coinciding with the engine output torque curve at a time of increasing the engine rotational number Nr in the power active mode.

In a step S19, it is judged whether or not the active mode switch 8 and the power mode switch 9 are in an on state, and when YES is established, the step 19 returns to the step S12 and when NO is established, the step 19 ends.

INDUSTRIAL APPLICABILITY

The present invention is useful for the controller of the engine and the variable capacity pump which increases the engine output, the engine rotational number and the set pressure of the hydraulic circuit in the working machine by operating the switches in the active mode and the power mode when it is desired to further increase the work force and the work speed in correspondence to the condition of the work field for the construction machine such as the hydraulic excavator and the like or the work load condition, so that a speedy work can be performed even under a heavy load and a strong work at the critical moment can be performed.

What is claimed is:

1. A construction machine having a working portion, comprising:

a hydraulic cylinder for operating the working portion of the construction machine;

a variable capacity pump for providing pressurized hydraulic fluid to the hydraulic cylinder via a discharge passageway, wherein the hydraulic cylinder is actuated when pressurized hydraulic fluid is supplied thereto, the variable capacity pump having a swash plate;

an engine for providing power to the construction machine, the engine connected to the variable capacity pump for driving the variable capacity pump;

fuel injection means for injecting fuel into the engine via a fuel passageway;

relief control means for regulating a pressure of hydraulic fluid in the discharge passageway of the variable capacity pump;

pump output control means for regulating an output flow rate of hydraulic fluid from the variable capacity pump;

control means for controlling an output flow rate of the fuel injection means, for controlling the relief control means, and for controlling the pump output control means, wherein the control means controls the fuel injection means, the relief control means, and the pump output control means to produce a first product of the pressure of hydraulic fluid in the discharge passageway of the variable capacity pump and the output flow rate of hydraulic fluid from the variable capacity pump, the first product being substantially a predetermined value when the construction machine is in a normal mode of operation;

wherein the control means controls the fuel injection means, the relief control means, and the pump output control means to produce a second product of the pressure of hydraulic fluid in the discharge passageway of the variable capacity pump and the output flow rate of hydraulic fluid from the variable capacity pump, the second product being greater than the first product when the construction machine is in an active mode of operation in which the construction machine requires a greater working force and a greater working speed than that required during the normal mode of operation;

wherein the control means controls the fuel injection means, the relief control means, and the pump output control means to produce, for a predetermined period of time, a third product of the pressure of hydraulic fluid in the discharge passageway of the variable capacity pump and the output flow rate of hydraulic fluid from the variable capacity pump, the third product being greater than the second product when the construction machine is in a power active mode of operation in which the construction machine requires, for the predetermined period of time, a greater working force and a greater working speed than that required during the active mode of operation;

wherein the control means controls the fuel injection means, the relief control means, and the pump output control means to produce the second product of the pressure of hydraulic fluid in the discharge passageway of the variable capacity pump and the output flow rate of hydraulic fluid form the variable capacity pump after the predetermined period of time has passed.

2. A construction machine having a working portion, according to claim 1, wherein the construction machine operates in the active mode upon an activation of a first switch and the construction machine operates in a power active mode upon an activation of the first switch and a second switch.

3. A construction machine having a working portion, according to claim 1, wherein:

the first product lies on a first pressure-output constant horsepower curve;

the second product lies on a second pressure-output constant horsepower curve corresponding to a higher horsepower than the first pressure-output constant horsepower curve; and the third product lies on a third pressure-output constant horsepower curve corresponding to a higher horsepower than the second pressure-output constant horsepower curve.

4. A construction machine having a working portion, according to claim 1, the relief control means comprising:

a relief valve disposed in a pipe passage branched from the discharge passageway of the variable capacity pump for adjusting the pressure of hydraulic fluid in the discharge passageway of the variable capacity pump, the relief valve having a spring side for adjusting a relief pressure of the relief valve; and a switch valve connected to the control means for receiving an electrical signal from the control means corresponding to an operational mode of the construction machine and connected to the spring side of the relief valve for providing pressurized pilot hydraulic fluid to the spring side of the relief valve corresponding to the operational mode of the construction machine.

5. A construction machine having a working portion, according to claim 1, the pump output control means comprising:

a servo piston connected to the swash plate of the variable capacity pump for controlling the angle of the swash plate;

a servo valve connected to the servo piston for supplying pressurized control hydraulic fluid to the servo piston and connected to the discharge passageway of the variable capacity pump, the servo valve having an operation portion;

a load sensing valve connected to the discharge passageway of the variable capacity pump and to the hydraulic cylinder for determining a load on the hydraulic cylinder, the load sensing valve being connected to the operation portion of the servo valve for providing pressurized hydraulic fluid to the operation portion of the servo valve;

a torque variable control valve connected to the load sensing valve for providing pressurized hydraulic fluid to the load sensing valve, the torque variable control valve having an operation portion; and an electromagnetic valve connected to the control means for receiving an electrical signal from the control means corresponding to the operational mode of the construction machine, the electromagnetic valve being connected to the operational portion of the torque variable control valve for providing pressurized hydraulic fluid to the torque variable control valve corresponding to the operational mode of the construction machine.

6. A construction machine having a working portion, according to claim 1, wherein the fuel injection means comprises:

a fuel injection pump connected to the engine via the fuel passageway, the fuel injection pump having a governor for controlling a rate of fuel flow from the fuel injection pump; and a governor motor for controlling the governor, the governor motor being connected to the control means for receiving an electrical signal from the control means.

7. A construction machine having a working portion, according to claim 1, the construction machine further comprising an engine rotational speed sensor for detecting a rotational speed of the engine, the engine rotational speed sensor being connected to the control means for sending an electrical signal to the control means corresponding to the detected engine rotational speed.

8. A controller for a construction machine having a working portion; a hydraulic cylinder for operating the working portion of the construction machine; a variable capacity pump for providing pressurized hydraulic fluid to the hydraulic cylinder via a discharge passageway, wherein the hydraulic cylinder is actuated when pressurized hydraulic fluid is supplied thereto, the variable capacity pump having a swash plate; an engine for providing power to the construction machine, the engine connected to the variable capacity pump for driving the variable capacity pump; and fuel injection means for injecting fuel into the engine via a fuel passageway, the controller comprising:

relief control means for regulating a pressure of hydraulic fluid in the discharge passageway of the variable capacity pump;

pump output control means for regulating an output flow rate of hydraulic fluid from the variable capacity pump;

control means for controlling an output flow rate of the fuel injection means, for controlling the relief control means, and for controlling the pump output control means, wherein the control means controls the fuel injection means, the relief control means, and the pump output control means to produce a first product of the pressure of hydraulic fluid in the discharge passageway of the variable capacity pump and the output flow rate of hydraulic fluid from the variable capacity pump, the first product being substantially a predetermined value when the construction machine is in a normal mode of operation;

wherein the control means controls the fuel injection means, the relief control means, and the pump output control means to produce a second product of the pressure of hydraulic fluid in the discharge passageway of the variable capacity pump and the output flow rate of hydraulic fluid from the variable capacity pump, the second product being greater than the first product when the construction machine is in an active mode of operation in which the construction machine requires a greater working force and a greater working speed than that required during the normal mode of operation;

wherein the control means controls the fuel injection means, the relief control means, and the pump output control means to produce, for a predetermined period of time, a third product of the pressure of hydraulic fluid in the discharge passageway of the variable capacity pump and the output flow rate of hydraulic fluid from the variable capacity pump, the third product being greater than the second product when the construction machine is in a power active mode of operation in which the construction machine requires, for the predetermined period of time, a greater working force and a greater working speed than that required during the active mode of operation;

wherein the control means controls the fuel injection means, the relief control means, and the pump output control means to produce the second product of the pressure of hydraulic fluid in the discharge passageway of the variable capacity pump and the output flow rate of hydraulic fluid from the variable capacity pump after the predetermined period of time has passed.

9. A controller for a construction machine, according to claim 8, wherein the construction machine operates in the active mode upon an activation of a first switch and the construction machine operates in a power active mode upon an activation of the first switch and a second switch.

10. A controller for a construction machine, according to claim 8, wherein:

the first product lies on a first pressure-output constant horsepower curve;

the second product lies on a second pressure-output constant horsepower curve corresponding to a higher horsepower than the first pressure-output constant horsepower curve; and the third product lies on a third pressure-output constant horsepower curve corresponding to a higher horsepower than the second pressure-output constant horsepower curve.

11. A controller for a construction machine, according to claim 8, the relief control means comprising:

a relief valve disposed in a pipe passage branched from the discharge passageway of the variable capacity pump for adjusting the pressure of hydraulic fluid in the discharge passageway of the variable capacity pump, the relief valve having a spring side for adjusting a relief pressure of the relief valve; and a switch valve connected to the control means for receiving an electrical signal from the control means corresponding to an operational mode of the construction machine and connected to the spring side of the relief valve for providing pressurized pilot hydraulic fluid to the spring side of the relief valve corresponding to the operational mode of the construction machine.

12. A controller for a construction machine, according to claim 8, the pump output control means comprising:

a servo piston connected to the swash plate of the variable capacity pump for controlling the angle of the swash plate;

a servo valve connected to the servo piston for supplying pressurized control hydraulic fluid to the servo piston and connected to the discharge passageway of the variable capacity pump, the servo valve having an operation portion;

a load sensing valve connected to the discharge passageway of the variable capacity pump and to the hydraulic cylinder for determining a load on the hydraulic cylinder, the load sensing valve being connected to the operation portion of the servo valve for providing pressurized hydraulic fluid to the operation portion of the servo valve;

a torque variable control valve connected to the load sensing valve for providing pressurized hydraulic fluid to the load sensing valve, the torque variable control valve having an operation portion; and an electromagnetic valve connected to the control means for receiving an electrical signal from the control means corresponding to the operational mode of the construction machine, the electromagnetic valve being connected to the operational portion of the torque variable control valve for providing pressurized hydraulic fluid to the torque variable control valve corresponding to the operational mode of the construction machine.

13. A method for controlling a construction machine having a working portion, comprising the steps of:

determining a state of an active mode switch; and determining a state of a power mode switch, wherein, if a result of the step of determining the state of the active mode switch is ON, the method further comprises:

measuring a pressure of hydraulic fluid being outputted from a variable capacity pump which provides pressurized hydraulic fluid to the working portion of either of the step of determining the state of the active mode switch;

measuring an output volume of pressurized hydraulic fluid from the variable capacity pump;

calculating a pump absorption torque based upon a result of the step of measuring the pressure of hydraulic fluid being outputted from the variable capacity pump and the step of measuring the output volume of pressurized hydraulic fluid from the variable capacity pump; and determining whether the result of the step of calculating a pump absorption torque exceeds a rated output torque of an engine of the construction machine, wherein, if a result of the step of determining whether the result of the step of calculating a pump absorption torque exceeds a rated output torque of an engine of the construction machine is YES, the method further comprises the steps of:

increasing a pressure in a discharge passageway of the variable capacity pump if each of the active mode switch and the power mode switch are determined to be in the ON state;

increasing a rotational speed of the engine;

increasing the pump absorption torque of the variable capacity pump to an active level if only the active mode switch is determined to be in the ON state and to a power active level for a predetermined period of time if each of the active mode switch and the power mode switch are determined to be in the ON state, wherein the active level is greater than a level during normal operation and the power active level is greater than the active level; and decreasing the pump absorption torque of the variable capacity pump to the active level, if the pump absorption torque is at a power-active level, after the predetermined period of time has passed.

* * * * *